United States Patent [19]
Bercynski et al.
[11] 3,934,523
[45] Jan. 27, 1976

[54] METHOD AND APPARATUS FOR REMOVING MOLTEN WASTE FROM A FURNACE

[75] Inventors: Frank A. Bercynski, Clarence; Jack J. Fritz, Buffalo; Theodore W. Lucas, Jr., Williamsville, all of N.Y.

[73] Assignee: Andco Incorporated, Buffalo, N.Y.

[22] Filed: Oct. 17, 1974

[21] Appl. No.: 515,625

[52] U.S. Cl. ..... 110/165 R; 110/28 P; 122/235 N
[51] Int. Cl.[2] ..... F23J 1/00
[58] Field of Search... 110/28 K, 28 P, 49 R, 165 R; 122/235 N

[56] References Cited

UNITED STATES PATENTS

| | | | |
|---|---|---|---|
| 1,452,045 | 4/1923 | Hawley | 110/28 |
| 1,838,667 | 12/1931 | Frisch et al. | 110/28 |
| 1,846,647 | 2/1932 | Leitch, et al. | 110/28 |
| 2,087,972 | 7/1937 | Heller | 122/235 |
| 2,185,865 | 1/1940 | Myers | 110/28 |
| 3,741,136 | 6/1973 | Stookey | 122/235 X |

FOREIGN PATENTS OR APPLICATIONS

| | | | |
|---|---|---|---|
| 682,033 | 11/1952 | United Kingdom | 110/28 |

*Primary Examiner*—Kenneth W. Sprague
*Attorney, Agent, or Firm*—Christel & Bean

[57] ABSTRACT

A body including a discharge passage and a runner surface extending into the passage fits in an opening provided adjacent the bottom of a furnace wherein solid material is exposed to hot gas in a manner forming a liquid waste which flows along a bottom surface of the furnace for removal. The discharge passage communicates with an outlet for removing liquid waste, and the runner surface meets the furnace bottom surface with a substantial portion of the runner surface being within the furnace. A conduit arrangement is connected to the furnace bustle pipe for supplying hot gas through a passage in the body which is directed toward the runner surface, and auxiliary fuel can be supplied to the conduit. The liquid waste material flows along the furnace bottom surface and along the runner surface through the discharge passage to the outlet, and the location of the runner surface minimizes heat loss from the liquid material. The hot gas supplied to the liquid waste material keeps it in a flowing state.

20 Claims, 5 Drawing Figures

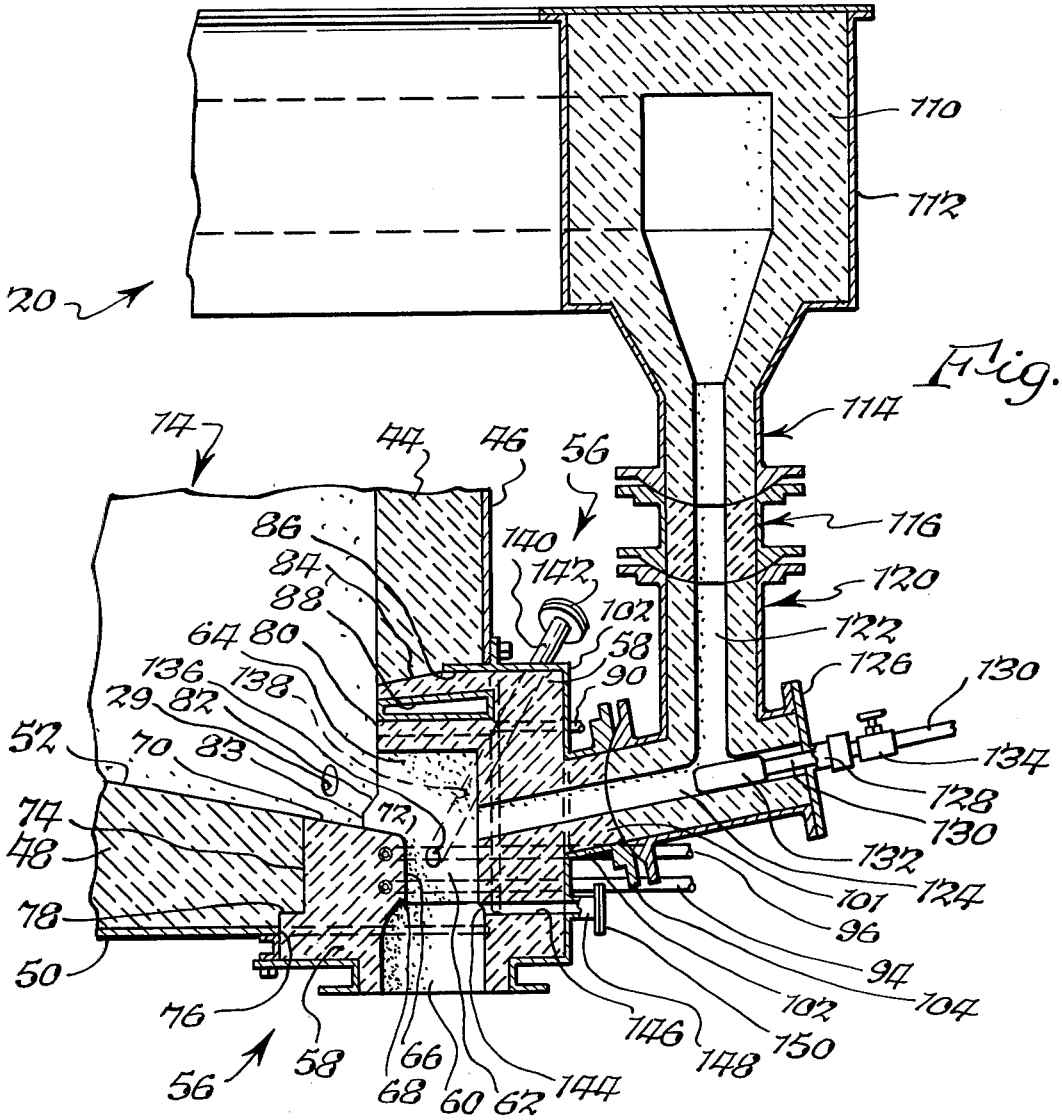
Fig. 3.
Fig. 4.
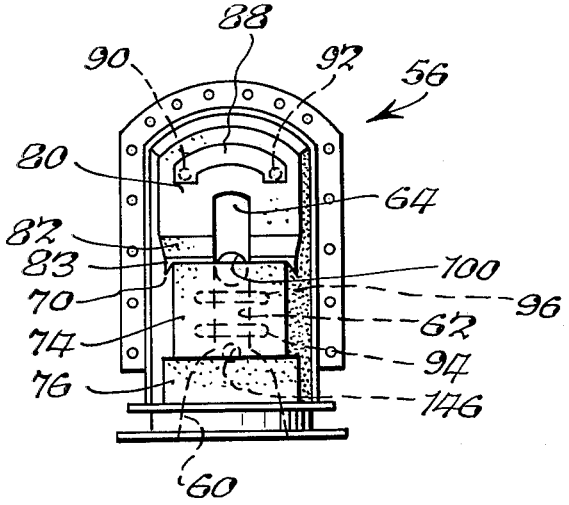
Fig. 5.
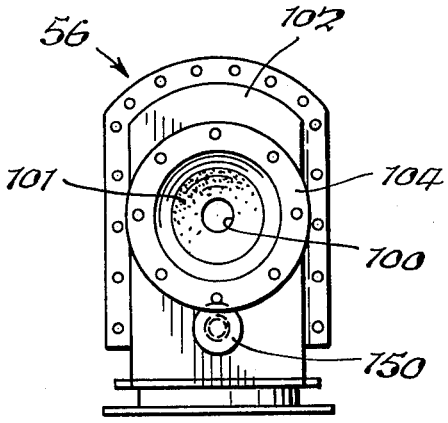

METHOD AND APPARATUS FOR REMOVING MOLTEN WASTE FROM A FURNACE

BACKGROUND OF THE INVENTION

This invention relates to the art of furnaces for liquifying non-combustible materials, and more particularly to a new and improved method and apparatus for removing molten material from such furnaces.

One area of the use of the present invention is in slagging pyrolysis solid waste disposal systems although the principles of the invention can be variously applied. In these and other systems to which the present invention is applicable, non-combustible material such as solid wastes or materials including metal, glass and mixtures of organic and inorganic material is charged into a furnace or combustion chamber wherein it is reduced to a slag which then is removed therefrom. One approach of the prior art to the problem of slag removal, known as tapping, was to plug a drain hole in the bottom of the furnace or combusion chamber with a refractory plug and remove the plug periodically to drain the molten material. Another approach was to continuously drain the furnace using a refractory lined trough, also known as a runner, to direct the material to some collection point. In this approach, if the trough is not thoroughly heated, some of the molten material is allowed to cool thereby increasing the viscosity and sometimes solidifying, causing build-ups in the horizontal runs and staliactite formations at vertical dropping points. On a continuously draining furnace, the formations can cause serious interruption to normal operations.

SUMMARY OF THE INVENTION

It is, therefore, a primary object of this invention to provide a new and improved method and apparatus for removing molten or liquid material from a furnace which liquifies noncombustible materials.

It is a more particular object of this invention to provide such method and apparatus whereby a low viscosity of molten material is maintained during removal.

It is a more particular object of this invention to provide such method and apparatus which minimizes heat loss from the molten material.

It is a more particular object of this invention to provide such method and apparatus which maintains the necessary heat input to the molten material to keep the viscosity low thereby preventing solidification.

It is a further object of this invention to provide such method and apparatus for continuously removing molten material in a manner which does not interfere with furnace operation.

It is a further object of this invention to provide such method and apparatus which is relatively simple in construction and convenient and economical to operate and maintain.

The present invention provides a method and apparatus for removing liquid waste material from a furnace which liquifies non-combustible materials wherein a discharge path is provided for directing the liquid waste material to flow from the interior of the furnace to an outlet and hot gas is supplied to the liquid waste material flowing along the path to maintain the material in a flowing state. The apparatus has a body shaped to fit in an opening adjacent the bottom of the furnace and includes a runner surface operatively associated with the furnace bottom surface and a discharge passage in the body communicating with the outlet, a substantial portion of the runner surface being within the furnace whereby heat loss from the liquid waste material is minimized as the material is removed from the furnace. A conduit means directs hot gas, which can be obtained from the furnace supply, onto the liquid waste material flowing along the runner surface to the discharge passage, and auxiliary fuel can be added to the hot gas.

The foregoing and additional advantages and characterizing features of the present invention will be clearly apparent from a reading of the ensuing detailed description together with the included drawing wherein:

BRIEF DESCRIPTION OF THE DRAWING FIGURES

FIG. 3 is a fragmentary sectional view taken about on line 3—3 of FIG. 2;

FIG. 4 is an elevational view of one end of the apparatus of the present invention; and FIG. 5 is an elevational view of an end of the apparatus of the present invention opposite the end shown in FIG. 4.

DETAILED DESCRIPTION OF THE ILLUSTRATED EMBODIMENT

Figure 1:
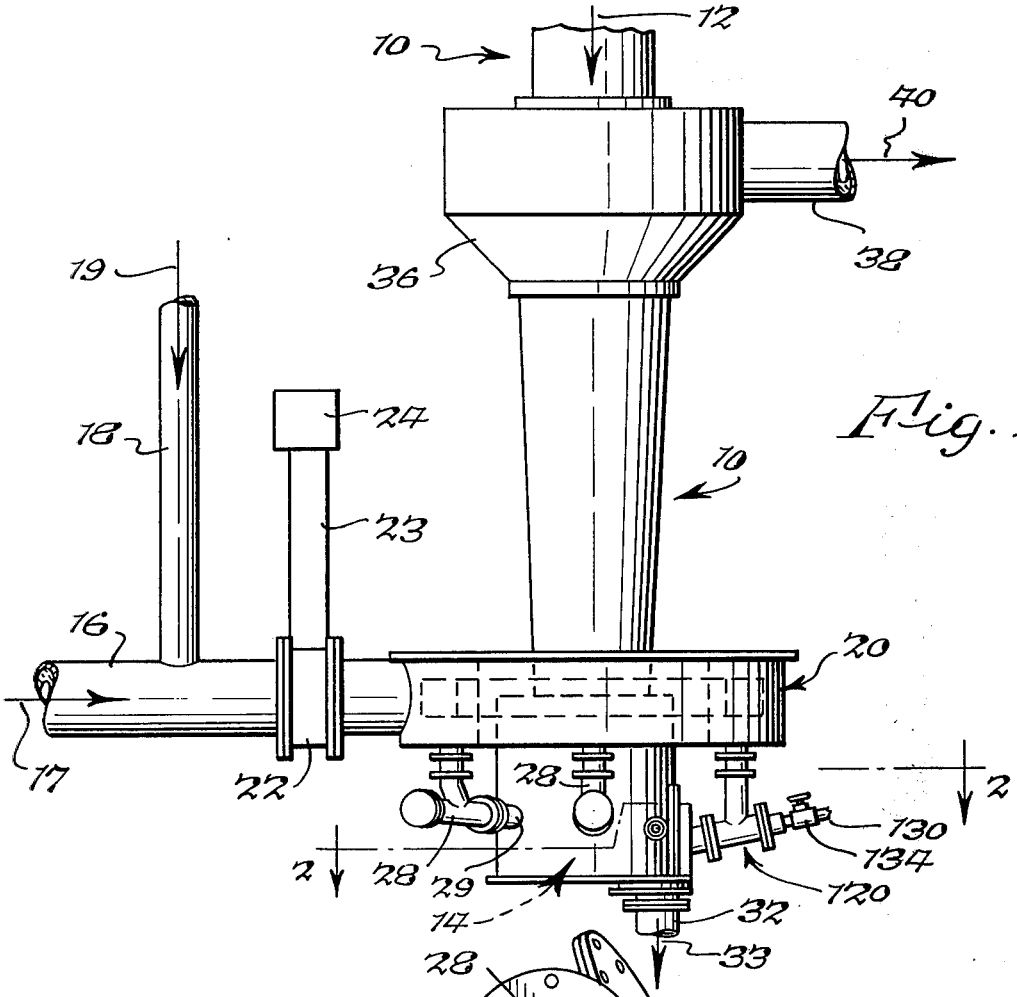
FIG. 1 is a fragmentary elevational view of a furnace provided with the apparatus of the present invention.
Figure 2:
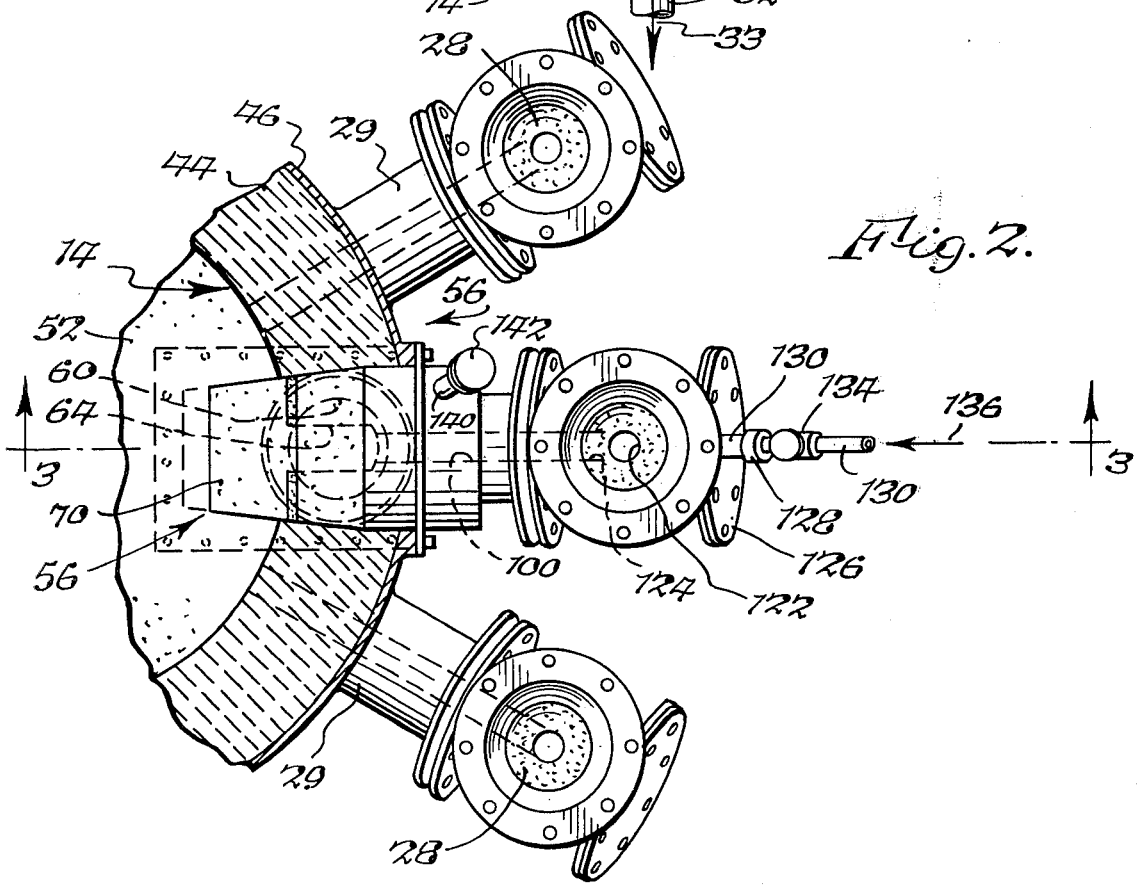
FIG. 2 is a fragmentary sectional view taken about on line 2—2 of FIG. 1.

Referring now to FIG. 1, a vertical combustion chamber or furnace, also known in the art as a gasifier, is partially shown at 10 and has an opening at the top (not shown) into which materials can be charged for movement downwardly through the chamber in a direction indicated by the arrow designated 12. A hearth 14 is located at the bottom of the combustion chamber 10 to which air at an elevated temperature and pressure is supplied so that the air moves upwardly in chamber 10. In particular, a conduit 16 is connected to a source of heated process air flowing in the direction indicated by arrow 17, the temperature of which is controlled or regulated by cold air flowing along a conduit 18 in the direction of arrow 19 which connects to conduit 16 thereby mixing controlled amounts of cold air with the heated air in conduit 16. Conduit 16 is connected to a distribution conduit or manifold 20 known in the art as a bustle pipe positioned adjacent the bottom of the gasifier 10. The flow of the hot air blast through conduit 16 is controlled by a valve 22 located in conduit 16 between bustle pipe 20 and the connection of conduit 18 to conduit 16. Valve 22 preferably is of the gate type including a gate housing 23 and a suitable control unit or mechanism 24, all of which is readily familiar to those skilled in the art. A plurality of tuyere stocks or feed lines 28 are connected to bustle pipe 20 circumferentially therearound, and the tuyere stocks 28 are connected to corresponding injection nozzles 29 which, in turn, are circumferentially spaced around the base of the gasifier 10 and communicate with the interior hearth 14 thereof. The air supplied to the hearth 14 is at a temperature sufficient to cause combustion in the chamber 10 not only for considerable burning of the waste material but also for melting of metal, glass and other solid materials so that they can move downwardly to the hearth 14 in the form of a molten material or slag which is withdrawn therefrom through a conduit 32 in the direction indicated by arrow 33 leading therefrom in FIG. 1.

The combustion in chamber 10 is incomplete and results in a gas, generally in the form of a combustible producers gas and vapors, which is tapped from the furnace 10 by an arrangement including a gas collection ring 36 and a conduit 38 leading therefrom. The flow of gas product, indicated by arrow 40, can be subjected to further treatment or combustion.

Molten material or slag is removed from gasifier 10 according to the present invention in the following manner. Referring now to FIG. 3, the furnace hearth 14 is defined in part by an upstanding or vertical insulating wall portion 44 of refractory material and an outer metal shell or lining 46 of steel. The hearth is completed by a base or bottom provided by a refractory portion 48 and an outer plate 50 of metal such as steel in a similar manner. The base portion 48 is disposed generally horizontally in use and has an inner surface 52 disposed in a downwardly sloping manner toward a slag tap opening provided in hearth 14 whereby the molten material or slag is caused by gravity to flow along surface 52 for removal from furnace 10. Refractory wall and base portions 44 and 48 and the respective metal liners 46 and 50 are provided with a suitable opening or passage therethrough for receiving a slag tap insert, generally designated 56, according to the present invention. Insert 56 is constructed so as to define a runner portion which meets surface 52 within the interior of hearth 14 and which directs or leads the flow of molten material or slag to a passage leading to the conduit 32 for removing the molten material or slag from furnace 10.

The slag tap insert 56 is of a shape and construction so as to removably fit into the opening provided in the furnace hearth adjacent the slag tap or collection point. Insert 56 has an inwardly tapered or somewhat wedge-shaped portion which extends into the furnace 10 when installed for use, and it has a portion which extends outwardly a relatively small distance from the furnace outer wall. In particular, slag tap insert 56 comprises a body 58 of refractory material provided with an internal discharge passage for connecting the interior of the furnace hearth 14 to the slag outlet 32. In preferred form the internal passage includes a first portion 60 adapted to be connected in a suitable manner to outlet 32, a second portion 62 of relatively smaller cross-sectional area in about the center of body 58 and a third portion 64 which opens to the hearth interior. Portion 62 is defined in part by a relatively smooth wall portion or surface 66 disposed generally vertically when insert 56 is in a position of use which surface 66 terminates at the bottom end as viewed in FIG. 3 in a relatively sharp edge portion 68. Edge 68 is located at the junction between passage portion 62 and the larger diameter passage portion 60. The upper end of surface 66 as viewed in FIG. 3 joins a runner surface 70 at a relatively smooth corner or junction 72. The runner surface 70 is disposed so as to be generally coplanar with the hearth bottom surface 52 whereby the molten material or slag flows smoothly downwardly along the surfaces 52 and 70 as viewed in FIG. 3 over the smooth edge 72 and downwardly whereupon the material drips from or otherwise leaves the edge 68. Runner surface 70 preferably is disposed at a relatively small acute angle relative to a horizontal plane and terminates in a relatively sharp edge where it meets a flat end face 74 of body 58 which end face is disposed generally vertically and in contact with a corresponding surface of the opening provided in the furnace hearth, in particular in base portion 48. Another end face 76 is offset outwardly of surface 74, the two surfaces being joined by a horizontally disposed ledge 78. In a similar manner, surface 76 and ledge 78 are in contact with corresponding surfaces in the opening formed in base portion 48.

The body 58 of insert 56 is provided with another end face 80 inwardly offset from end face 74 by an amount such that end face 80 preferably is flush with the interior surface of furnace wall 44. End face 80 extends toward runner surface 70 and meets an outwardly extending and inclined surface 82 which meets another surface 83 which terminates at the runner surface 70. The opposite end of surface 80 meets an outwardly inclined surface 84 at the top of body 58 as viewed in FIG. 3. Surface 84, in turn, meets a generally horizontal top surface 86 leading therefrom and extending outwardly of the hearth shell 46. Surfaces 84 and 86 abut or contact corresponding surfaces of the opening formed in furnace wall 44.

The upper portion of body 58 adjacent end face 80 and surface 84 is provided with a region or chamber which is enclosed by a housing 88 of suitable heat conducting material such as metal. The interior of housing 88 is supplied with cooling liquid, preferably water, from conduits 90, 92 for cooling this portion of body 58 during use. In a similar manner, the lower portion of body 58 is provided with passages in communication with conduits 94, 96 for conducting cooling liquid such as water through this portion of the body. The portion of the insert body 58 which extends forwardly or outwardly of the furnace wall 44 and shell 46 is of sufficient size or depth to include a hot gas supply passage 100 formed therein which communicates with the region between discharge passage portions 62 and 64. Supply passage 100 opens to the discharge passage at a location generally opposite or disposed toward the edge or corner 72 between runner 70 and surface 66. Passage 100 terminates at the opposite end thereof in a pipelike, cylindrical extension 101 of the refractory body 58. The portion of body 58 including passage 100 and extension 101 is provided with an outer shell 102, similar to furnace shell 46, which shell 102 also encloses pipe 101 and terminates in an annular flange 104 at the end of pipe 101.

Hot gas from bustle pipe 20 is supplied to passage 100 so as to be directed onto the slag or molten material flowing along runner 70 and over edge 72 and along surface 66 in the following manner. The furnace is equipped with one additional tuyere stock or feed line assembly connecting bustle pipe 20 to passage 100. In particular, bustle pipe 20 as shown in FIG. 3 has an internal wall or lining 110 of suitable refractory material which is enclosed by an outer shell 112 of steel or similar metal. Bustle pipe 20 is provided with a depending conduit 114 which in the present instance is an integral extension of the refractory material and metal shell forming bustle pipe 20. Conduit 114 is connected through a spherical coupling generally designated 116 to an elbow-like connecting element generally designated 120. Elbow 120, in turn, is connected to pipe 101. In particular, elbow 120 includes a first passage 122 in the arm thereof connected to coupling 116, and passage 122 communicates through coupling and conduit 114 with the interior of bustle pipe 20. In the position of use shown in FIG. 3, the arm of elbow 120 having passage 122 in disposed generally vertically. Elbow 120 also includes a second passage 124 in the arm thereof connected to pipe 101, the passage 124 being in communication with passage 122 and connected to passage 100 of pipe 101. The abutting ends of pipe 101 and elbow 120 are provided with mating concave and convex surfaces, respectively, to provide a self-aligning or spherical coupling in a known manner. The other arm of elbow 120 connects to coupling 116 in a similar manner. Coupling 116 and elbow 120 both are formed preferably of refractory material and provided with an outer metal shell, the shell being formed into annular flanges at the connecting ends thereof.

The portion of elbow 120 containing passage 124 is closed at the outer end, i.e. the end opposite the connection to pipe 101, by a cap or closure element 126. Element 126 is provided with a central hub 128 which receives and supports a fuel supply conduit 130 which extends into passage 124 where it connects to a nozzle element 132 for introducing auxiliary fuel to the hot gas supplied to passage 100 whenever operating conditions require this to be done. Control of the flow of auxiliary fuel through conduit 130 to nozzle 132 is provided by a conventional valve element 134 positioned on conduit 130 at a location for manual operation.

Body 58 is provided with an opening or hole 136 in discharge passage portion 62 adjacent surface 66 and a passage or bore 138 found in body 58 and communicating with opening 136 allows external access to or inspection of this portion of the discharge passage with a tool or implement such as a rod. Passage 138 is extended from body 58 by a pipe or conduit 140 which is provided with a removable cap or closure 142. Another access hole or opening 144 is provided in discharge passage portion 60, opposite edge 68, and a passage 146 allows external access or inspection. Passage 146 is extended from body 58 by a conduit or pipe 148 provide with a cap or closure 150.

Molten material or slag is removed from furnace 10 in the following manner. Exposure of the waste material to the heated process air supplied to hearth 14 forms a flowable material in a molten form known in the art as slag. The material flows along the downwardly sloping inner surface 52 of the hearth base or bottom under the influence of gravity and then further along runner surface 70 into the discharge passage of the slag tap insert 56. The flow of molten material or slag continues along runner surface 70 and then around the smooth edge or corner 72 whereupon it flows generally vertically downwardly along passage surface 66 and then leaves edge 68 to flow through passage portion 60 and ultimately into conduit 32 shown in FIG. 1.

While the molten material or slag flows from the furnace 10 in the foregoing manner, it is exposed to pre-heated gas in a manner which maintains the material in a molten or low viscosity, flowable state. In particular, heated process air from bustle pipe 20 is conveyed and directed by the apparatus of the present invention onto the flow of molten material or slag leaving the furnace hearth 14 and flowing toward outlet conduit 32. The heated process air flows from bustle pipe 20 along passages 122 and 100, into discharge passage portions 62 and 64, and then onto and along edge 72 and runner surface 70. Passage 100 preferably is disposed at a relatively small angle, for example about 10°, relative to a horizontal plane in the position of use. Auxiliary fuel can be added by nozzle 132 to the flow of process air or gas through passages 100, 101 to raise the temperature if additional heat is required.

The runner surface 70 provided by the apparatus of the present invention is relatively short, preferably about 18 inches in length, and it is located within the furnace thereby providing a runner extending a relatively short distance between the furnace melting zone to the discharge point. As a result, the furnace liquid discharge point is located within the boundries of the refractory lined furnace walls so that lower heat loss from the molten material or slag results. In some situations, it may be advantageous to provide runner surface 70 with a liner of metal.

Providing the pre-heated gas, i.e. the heated process air, directly over runner surface 70 according to the present invention adds the necessary heat input to the molten material or slag to keep its viscosity low and prevent solidification. The arrangement of the present invention, including the relatively short, enclosed runner surface 70, makes possible the introduction of preheated air directly onto the entire length of the runner. The foregoing is accomplished with a relatively simple construction. The arrangement of bustle pipe 20 and tuyere assemblys 28 is included in many existing furnaces of the type to which the present invention is applicable. Installation of the slag tap insert apparatus of the present invention in an existing furnace merely requires the addition of one more tuyere assembly 120 at the location of the liquid discharge point for directing a portion of the heated process air over the molten flow.

The fact that body 58 is of refractory material and is provided with an outer metal liner 102 together with the sealing arrangement of the inwardly tapered shape of body 58, stepped wall surfaces 74, 76 and 78, and peripheral flange of the liner makes possible continuous draining of molten material or slag from the furnace 10 without disturbing the chemical process occurring therein. In other words, the apparatus of the present invention is constructed and installed in a manner maintaining internal furnace pressure. The slag tap insert apparatus 56 of the present invention is removable as a unit to facilitate maintenance. The furnace is shut down, and removing apparatus 56 merely involves disconnecting tuyere assembly 120, removing the bolts or fasteners, and then pulling the insert 56 out from the opening in the furnace.

Another advantage of the method and apparatus of the present invention is that the heat contained in the waste material, i.e. the heat value thereof, is utilized to provide heat to the heated process air which is directed onto runner surface 70 to keep the slag molten. In particular, the waste material undergoing combustion in chamber 10 gives off a heated gas product which is tapped from the furnace through conduit 38 for further treatment or combustion, as previously described, whereupon the resulting heated gas product can be fed back or recycled for use as the heated process air flowing in conduit 16 to bustle pipe 20 and ultimately to the slag tapping region including runner 70 and the discharge passage as previously described. Thus heat from the process itself advantageously is supplied to the liquid waste material being discharged from the furnace, as opposed to obtaining the heat from an external or separate source.

It is therefore apparent that the present invention accomplishes its intended objects. While a single embodiment of the invention has been described in detail, this is for the purpose of illustration, not limitation.

I claim:

1. In a furnace wherein solid material is exposed to hot gas in a manner forming a liquid waste, said furnace including means for distributing hot gas to the interior of said furnace, apparatus for removing said liquid waste from said furnace to an outlet comprising:

a. means for defining a discharge passage directing the liquid waste material from the interior of said furnace to the outlet; and b. means for supplying hot gas to the liquid waste material flowing from the interior of said furnace through said discharge passage to the outlet to maintain the liquid waste material in a flowing state said means for supplying hot gas to the liquid waste material comprising conduit means having an inlet connected to said hot gas distributing means of said furnace and an outlet in communication with said discharge passage and located so as to direct hot gas onto the flow of liquid waste material.

2. Apparatus according to claim 1, wherein said furnace includes a base having a surface disposed so as to cause the liquid waste material to flow toward the outlet and wherein said apparatus further comprises means defining a runner surface operatively associated with said base surface for directing the flow of liquid waste material to said discharge passage.

3. Apparatus according to claim 2, wherein said discharge passage is disposed generally vertically and said base surface and said runner surface are located above the outlet and are disposed in a downwardly inclined direction from the interior of said furnace to said discharge passage.

4. Apparatus according to claim 2, wherein said base surface has a portion terminating within the interior of said furnace and said runner surface extends into said furnace to meet the terminating portion of said base surface whereby said runner surface is exposed to heat from said furnace so as to provide heat to the flow of liquid waste material along said runner surface.

5. Apparatus according to claim 2, wherein said means supplying hot gas is positioned so as to direct hot gas onto the liquid waste material flowing along said runner surface to said discharge passage.

6. Apparatus according to claim 5, further including means operatively associated with said hot gas supplying means for adding fuel to the hot gas.

7. Apparatus according to claim 1, further including means operatively associated with said conduit means for adding fuel to the hot gas directed onto the flow of liquid waste material.

8. Apparatus according to claim 3, wherein said runner surface terminates at an edge in said discharge passage above the outlet and wherein said hot gas supplying means is positioned so as to direct hot gas onto said runner surface and said edge.

9. A device for installation in an opening provided adjacent the bottom of a furnace wherein solid material is exposed to hot gas in a manner forming a liquid waste which flows along a bottom surface of said furnace for removal therefrom, said device comprising:

a. a body shaped to fit in said opening in a manner closing the same;

b. a discharge passage provided in said body for removing liquid waste material from the interior of said furnace; and c. a runner surface provided in said body in a manner so as to be in communication with said discharge passage and in operative relationship to said furnace bottom surface, said runner surface meeting said furnace bottom surface inwardly of said opening in a manner such that a substantial portion of said runner surface is within the interior of said furnace inwardly of said opening and said runner surface meeting said discharge passage within the outer surface of said furnace whereby heat loss from said liquid waste material is minimized as said material is removed from said furnace.

10. Apparatus according to claim 9, wherein said discharge passage is disposed generally vertically and wherein said furnace bottom surface and said runner surface are sloped in a downward direction whereby said liquid waste material flows under the influence of gravity along said surfaces into and along said discharge passage.

11. Apparatus according to claim 9, wherein said body has inwardly tapered wall portions and said opening has tapered surface portions for abutting said body wall portions.

12. Apparatus according to claim 9, further including sealing means on said body for sealing engagement with said furnace adjacent said opening.

13. Apparatus according to claim 9, further including heat transfer means in said body.

14. Apparatus according to claim 9, wherein the lateral dimension of said runner surface is greater than the corresponding lateral dimension of said discharge passage where said surface and said passage are in communication.

15. Apparatus according to claim 9, further including means for supplying hot gas to said liquid waste material flowing from said furnace through said discharge passage to maintain said liquid waste material in a flowing state.

16. Apparatus according to claim 15, further including fuel supplying means operatively connected to said hot gas supplying means for adding fuel to the hot gas supplied to said liquid waste material.

17. A method of removing liquid waste material from a furnace wherein hot gas is supplied to the furnace and solid material is exposed to said hot gas in a manner forming said liquid waste material, comprising the steps of:

a. providing a discharge path for directing said liquid waste material to flow from the interior of said furnace to an outlet; and b. withdrawing a portion of said hot gas before it is supplied to the furnace and conveying said hot gas to said liquid waste material flowing from said furnace along said discharge path to maintain said liquid material in a flowing state.

18. A method according to claim 17, further including adding fuel to the hot gas supplied to said liquid waste material.

19. A method according to claim 17 further comprising the steps of:

a. withdrawing from said furnace heated gas product evolved when said liquid waste material is formed from said solid material upon exposure to said hot gas; and b. conveying said heated gas product to said liquid waste material to augment the hot gas supplied to said liquid waste material to maintain said liquid material in a flowing state.

20. In a furnace wherein solid material is exposed to hot gas in a manner forming a liquid waste which flows along a bottom surface of the furnace for removal therefrom, said furnace including means for distributing hot gas to the interior of said furnace and having an opening adjacent said bottom surface, apparatus for removing said liquid waste material comprising:

a. a body shaped to fit in said opening in a manner closing the same;

b. a discharge passage provided in said body for removing liquid waste material from the interior of said furnace;

c. a runner surface provided in said body in a manner so as to be in communication with said discharge passage and in operative relationship to said furnace bottom surface, said runner surface meeting said furnace bottom surface inwardly of said opening in a manner such that a substantial portion of said runner surface is within the interior of said furnace inwardly of said opening and said runner surface meeting said discharge passage within the outer surface of said furnace whereby heat loss from said liquid waste material is minimized as said material is removed from said furnace; and d. means for supplying hot gas to the liquid waste material flowing from the interior of said furnace through said discharge passage to the outlet to maintain the liquid waste material in a flowing state, said means for supplying hot gas to the liquid waste material comprising conduit means having an inlet connected to said hot gas distributing means of said furnace and an outlet in communication with said discharge passage and located so as to direct hot gas onto the flow of liquid waste material.

* * * * *

UNITED STATES PATENT AND TRADEMARK OFFICE

CERTIFICATE OF CORRECTION

PATENT NO. : 3,934,523

DATED : January 27, 1976

INVENTOR(S) : Frank A. Berczynski, Jack J. Fritz and Theodore W. Lucas, Jr.

It is certified that error appears in the above-identified patent and that said Letters Patent are hereby corrected as shown below:

Front Page, left column, first line underneath heading of UNITED STATES PATENT: "Bercynski et al" should be --Berczynski et al--;

Front Page, [75], line 1, "Bercynski" should be --Berczynski--.

Signed and Sealed this

Thirteenth Day of July 1976

[SEAL]

*Attest:*

RUTH C. MASON
*Attesting Officer*

C. MARSHALL DANN
*Commissioner of Patents and Trademarks*